US011162162B2

(12) United States Patent
Minamino et al.

(10) Patent No.: US 11,162,162 B2
(45) Date of Patent: Nov. 2, 2021

(54) STEEL WITH HIGH HARDNESS AND EXCELLENT TOUGHNESS

(71) Applicants: OSAKA UNIVERSITY, Suita (JP); KOMATSU LTD., Tokyo (JP)

(72) Inventors: Yoritoshi Minamino, Suita (JP); Koji Hagihara, Suita (JP); Koji Yamamoto, Tokyo (JP); Shohei Ikurumi, Tokyo (JP); Yusuke Hiratsuka, Himeji (JP); Takeshi Fujimatsu, Himeji (JP); Toshiyuki Sugimoto, Himeji (JP)

(73) Assignees: OSAKA UNIVERSITY, Suita (JP); KOMATSU LTD., Tokyo (JP)

( * ) Notice: Subject to any disclaimer, the term of this patent is extended or adjusted under 35 U.S.C. 154(b) by 195 days.

(21) Appl. No.: 16/467,225

(22) PCT Filed: Aug. 8, 2018

(86) PCT No.: PCT/JP2018/029752
§ 371 (c)(1),
(2) Date: Jun. 6, 2019

(87) PCT Pub. No.: WO2019/035401
PCT Pub. Date: Feb. 21, 2019

(65) Prior Publication Data

US 2020/0080180 A1 Mar. 12, 2020

(30) Foreign Application Priority Data

Aug. 18, 2017 (JP) ..... JP2017-158007

(51) Int. Cl.

| | |
|---|---|
| ***C22C 38/46*** | (2006.01) |
| ***C21D 1/28*** | (2006.01) |
| ***C21D 6/00*** | (2006.01) |
| ***C21D 6/02*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/44*** | (2006.01) |

(52) U.S. Cl.
CPC ..... *C22C 38/46* (2013.01); *C21D 1/28* (2013.01); *C21D 6/004* (2013.01); *C21D 6/005* (2013.01); *C21D 6/008* (2013.01); *C21D 6/02* (2013.01); *C22C 38/001* (2013.01); *C22C 38/002* (2013.01); *C22C 38/02* (2013.01); *C22C 38/04* (2013.01); *C22C 38/06* (2013.01); *C22C 38/44* (2013.01); *C21D 2211/004* (2013.01); *C21D 2211/008* (2013.01)

(58) Field of Classification Search
CPC ..... C22C 38/46; C22C 38/001; C22C 38/002; C22C 38/02; C22C 38/04; C22C 38/06; C22C 38/44; C21D 1/28; C21D 6/004; C21D 6/005; C21D 6/008; C21D 6/02; C21D 2211/004; C21D 2211/008
USPC ..... 420/109
See application file for complete search history.

(56) References Cited

U.S. PATENT DOCUMENTS

| | | | | |
|---|---|---|---|---|
| 4,770,721 | A * | 9/1988 | Yamamoto | C21D 6/02 148/548 |
| 2018/0259022 | A1 | 9/2018 | Teramoto et al. | |

FOREIGN PATENT DOCUMENTS

| | | | | | |
|---|---|---|---|---|---|
| AU | 2016324658 | A1 | | 3/2018 | |
| CA | 2316183 | A1 | | 5/2000 | |
| CN | 1873042 | A | | 12/2006 | |
| CN | 103255351 | A | | 8/2013 | |
| JP | H07-300651 | A | | 11/1995 | |
| JP | 2000-204444 | A | | 7/2000 | |
| JP | 2007-231345 | A | | 9/2007 | |
| JP | 2013104070 | A | * | 5/2013 | C22C 38/00 |
| JP | 2017-57479 | A | | 3/2017 | |
| JP | 2017057479 | A | * | 3/2017 | C22C 38/00 |
| WO | WO-2017/039012 | A1 | | 3/2017 | |

* cited by examiner

*Primary Examiner* — Humera N. Sheikh
*Assistant Examiner* — John D Schneible
(74) *Attorney, Agent, or Firm* — Faegre Drinker Biddle & Reath LLP

(57) ABSTRACT

A steel with high hardness and excellent toughness contains, in mass %, 0.40-1.00% C, 0.10-2.00% Si, 0.10-1.00% Mn, 0.030% or less P, 0.030% or less S, 1.10-3.20% Cr, 0.010-0.10% Al, and 0.15-0.50% V, and further contains at least one or two of 2.50% or less Ni and 1.00% or less Mo, with an amount of (C+V) being 0.60% or more in mass %, with the balance consisting of Fe and unavoidable impurities. The steel has a microstructure which is a martensitic structure with finely dispersed Fe-based ε carbides, with its prior austenite grain size being 20 μm or less.

1 Claim, No Drawings

STEEL WITH HIGH HARDNESS AND EXCELLENT TOUGHNESS

TECHNICAL FIELD

The present invention relates to steels with high hardness and excellent toughness, particularly superior in wear resistance and durability, used for machinery including automobiles, aircraft, ships and other transport machinery, earth-moving machinery, construction machinery, and industrial machinery, for their components including gears, shafts and other driving system components, speed reducer components, excavating mechanism or its peripheral mechanism components, and bearing components.

This application claims priority based on Japanese Patent Application No. 2017-158007 filed on Aug. 18, 2017, the entire disclosure of which is incorporated herein by reference.

BACKGROUND ART

Steels used for components of transport and other machinery, particularly steels used for components requiting excellent wear resistance and fatigue characteristics, are generally hardened by quenching before being used. A steel material primarily having a martensitic structure as a result of quenching has a hardness determined by its C (carbon) content. An increased C content leads to an increased hardness of the steel material. Increasing the hardness of a steel material, however, lowers its toughness, making the steel material susceptible to cracking upon impact. The steel material thus requires a good balance between hardness and toughness.

In this regard, as a conventional technique, an invention of a rolling bearing component for high temperature use, having an excellent rolling fatigue life under foreign matter-intruded environments and high temperature environments, has been proposed (see, for example, Japanese Patent Application Laid-Open No. 2000-204444 (Patent Literature 1)). The proposed invention does not require addition of V as an indispensable element as in the present invention; it merely restricts the maximum diameter of carbides within the structure obtained after tempering to be 8 μm or less. While the proposed invention ensures an excellent rolling fatigue life even when carbides of 8 μm or close to 8 μm in diameter are included, there is no statement as to whether high toughness can be obtained together. Patent Literature 1 fails to suggest any measures for achieving high toughness.

On the other hand, an invention of steel with high hardness and excellent toughness used for components of transport and other machinery has been proposed (see, for example, Japanese Patent Application Laid-Open No. 2017-057479 (Patent Literature 2)). According to the proposed invention, the steel is heated to a temperature range of a dual phase of austenite and cementite, and then quenched to obtain a structure of martensite and spheroidized cementite. The size, shape, and distribution state of the carbides are controlled, and in particular, carbides on the grain boundaries are eliminated, so as to considerably improve the toughness. With the proposed invention, however, heating in the dual phase range and the subsequent quenching are indispensable. To ensure appropriate conditions of carbides, the holding times and temperatures need to be controlled precisely, leading to an increased load on the practical process steps.

CITATION LIST

Patent Literature

Patent Literature 1: Japanese Patent Application Laid-Open No. 2000-204444

Patent Literature 2: Japanese Patent Application Laid-Open No. 2017-057479

SUMMARY OF INVENTION

Technical Problem

An object of the present invention is to provide a steel with high hardness and high toughness which contains C of at least a medium carbon level, i.e. a steel called a medium-carbon steel or a high-carbon steel, and which can be subjected to simple heat treatment such as high-temperature quenching from an austenite region of not lower than a dissolution temperature of cementite.

Solution to Problem

Generally, when a steel containing C of at least a medium carbon level as its chemical component is subjected to high-temperature quenching from the austenite region, cementite will be fully dissolved at a high heating temperature, so the steel will lose the grain boundary pinning effect, resulting in coarsened austenite grains. The grain size, i.e. the prior austenite grain size, after quenching will remain coarse, in which case intergranular fracture which is brittle fracture would likely occur, leading to reduced toughness.

In view of the foregoing, solutions of the present invention adopt a steel that contains C of at least a medium carbon level as its chemical component and has V added thereto. When V is contained as an indispensable additive element, V-containing fine carbides which exist in the austenite region attaining a high processing temperature serve to pin the migration of austenite grain boundaries, so that the austenite grain size can be maintained fine. Accordingly, the grain size of martensite that is generated after quenching can be maintained fine and ductile fracture becomes dominant, whereby high toughness is obtained. Specifically, the inventors have found that the effects of the present invention can be obtained by the solutions of the present invention as follows.

Of the solutions of the present invention for achieving the above object, the first solution is a steel with high hardness and excellent toughness that contains, in mass %, 0.40-1.00% C, 0.10-2.00% Si, 0.10-1.00% Mn, 0.030% or less P, 0.030% or less S, 1.10-3.20% Cr, 0.010-0.10% Al, and 0.15-0.50% V, and further contains one or both of 2.50% or less Ni and 1.00% or less Mo, with an amount of (C+V) being 0.60% or more in mass %, with the balance consisting of Fe and unavoidable impurities. The steel has a microstructure which is a martensitic structure tempered at a low temperature of 130° C. to 250° C., with its prior austenite grain size being 20 μm or less.

The second solution is the steel with high hardness and excellent toughness of the first solution of the present invention, having the chemical composition and the microstructure of the first solution, wherein the martensitic structure tempered at a low temperature of 130° C. to 250° C. has fine carbides containing V (hereinafter, referred to as V-containing fine carbides) with a diameter of 0.50 μm or less precipitated and dispersed therein, and the amount of the precipitated V-containing fine carbides is 0.10-0.90 vol % in terms of the proportion to the volume of entire martensite (hereinafter, referred to as "total martensite volume").

The third solution is the steel with high hardness and excellent toughness of the first solution of the present invention, having the chemical composition and the microstructure of the first solution, wherein the amount of precipitated cementite in the martensitic structure tempered at a low temperature of 130° C. to 250° C. constitutes 0.50 vol % or less of the total martensite volume.

The fourth solution is the steel with high hardness and excellent toughness of the second solution of the present invention, having the chemical composition and the microstructure of the first solution and the microstructure of the second solution, wherein the amount of precipitated cementite in the martensitic structure tempered at a low temperature of 130° C. to 250° C. constitutes 0.50 vol % or less of the total martensite volume.

Effects of the Invention

In the present invention, a high hardness that would not be achieved by high-temperature tempering is obtained by adopting the martensitic structure having Fe-based c carbides finely dispersed as a result of low-temperature tempering at 130° C. to 250° C. Further, with V contained as an indispensable additive element, V-containing fine carbides existing at the heating temperature for quenching serve to pin the migration of the austenite grain boundaries, enabling the austenite grains to be kept fine with the grain size of not greater than 20 μm. Accordingly, after quenching, the martensitic structure becomes fine with the prior austenite grain size of 20 μm or less, and thus, ductile fracture becomes dominant as a mode of fracture, whereby high toughness is achieved. These configurations produce useful effects that components requiring high toughness, such as those for transport and other machinery, can be supplied by making steel components using the steel with high hardness and high toughness.

Further, in the martensitic structure, V-containing fine carbides with a diameter of 0.50 μn or less are precipitated dispersively. With the precipitated amount being set to be 0.10-0.90 vol % of the total martensite volume, the grain refining effects can be obtained, without causing a decrease in toughness due to the brittleness of the V-containing fine carbides themselves, and coarsening of the prior austenite grain size is prevented, whereby high toughness is achieved together with high hardness.

Furthermore, the amount of the precipitated cementite in the martensitic structure tempered at a low temperature of 130° C. to 250° C. is set to be 0.50 vol % or less of the total martensite volume. While cementite would normally likely grow on grain boundaries and cause cracking along the boundaries after quenching and tempering, in the present invention, the amount of the precipitated cementite is restricted quantitatively, to thereby prevent the reduction of toughness.

DESCRIPTION OF EMBODIMENT

Prior to describing an embodiment of the present invention, the constituent features of the invention according to the solutions of the present invention will be explained below in order of: the reasons for limiting the chemical components of the steel, except for Fe and unavoidable impurities, the reasons for causing the microstructure of the inventive steel to be a martensitic structure tempered at a low temperature of 130° C. to 250° C., the reasons for limiting the size and precipitated amount of V-containing carbides in the martensitic structure, the reasons for limiting the proportion of the amount of precipitated cementite in the martensitic structure to the total martensite volume, and the reasons for limiting the prior austenite grain size. It should be noted that % used for chemical components is mass %.

C: 0.40-1.00%

C is an element which improves hardness, wear resistance, and fatigue life after quenching and tempering. However, if the C content is less than 0.40%, sufficient hardness cannot be obtained. On the other hand, if the C content is more than 1.00%, the toughness will be impaired, and further, the hardness of the steel material will increase, impairing the workability such as machinability and forgeability. Accordingly, the C content is set to 0.40-1.00%, desirably to 0.50-1.00%, and further desirably to 0.50-0.90%.

Si: 0.10-2.00%

Si is an element which is effective in deoxidation of the steel, and serves to impart required hardenability to the steel and enhance its strength. To achieve these effects, the Si content needs to be 0.10% or more, or desirably 0.20% or more. On the other hand, if Si is contained in a large amount, it will increase the hardness of the material, impairing the workability such as machinability and forgeability. It is thus necessary to keep the Si content to be 2.00% or less, and desirably 1.55% or less. Accordingly, the Si content is set to 0.10-2.00%, and desirably to 0.20-1.55%.

Mn: 0.10-1.00%

Mn is an element which is effective in deoxidation of the steel and necessary for imparting required hardenability to the steel and enhancing its strength. To this end, the Mn content needs to be 0.10% or more, or desirably 0.15% or more. On the other hand, if Mn is contained in a large amount, it will decrease the toughness. Further, it may combine with S to form MnS, which will also decrease the toughness or contribute to cracking during processing. It is thus necessary to keep the Mn content to be 1.00% or less, and desirably 0.70% or less. Accordingly, the Mn content is set to 0.10-1.00%, desirably to 0.15-1.00%, and further desirably to 0.15-0.70%.

P: 0.030% or less

P is an impurity element which is contained unavoidably in the steel. P segregates in the grain boundary and deteriorates the toughness. Accordingly, the P content is set to 0.030% or less, and desirably to 0.015% or less.

S: 0.030% or less

S is an element which combines with Mn to form MnS, and deteriorates the toughness. Accordingly, the S content is set to 0.030% or less, and desirably to 0.010% or less.

Cr: 1.10-3.20%

Cr is an element which improves hardenability. To sufficiently obtain the effect, the Cr content needs to be 1.10% or more, desirably 1.20% or more, and further desirably 1.35% or more. On the other hand, if Cr is added in an excessively large amount, it will promote precipitation of carbides in grain boundaries during the cooling process following quenching, adversely affecting the toughness. To avoid this, it is necessary to keep the Cr content to be 3.20% or less, desirably 2.50% or less, and further desirably 2.30% or less. Accordingly, the Cr content is set to 1.10-3.20%, desirably to 1.20-2.50%, and further desirably to 1.35-2.30%.

Al: 0.010-0.10%

Al is added as it is an element indispensable to deoxidation of the steel. Further, Al may combine with N to generate AlN, thereby suppressing grain coarsening. For achieving these effects, the Al content needs to be 0.010% or more. On the other hand, if Al is added in a large amount, hot workability will be impaired. It is thus necessary to keep the Al content to be 0.10% or less, and desirably 0.050% or less. Accordingly, the Al content is set to 0.010-0.10%, and desirably to 0.015-0.050%.

V: 0.15-0.50%

V is an element indispensable for achieving high toughness by refining of grains, as V combines with C to form fine carbides, and the carbides serve to pin the grain boundaries at the time of heating for quenching, thereby keeping the grains fine. In order for the carbides to effectively pin the grain boundaries in the steel, the steel needs to be once heated to a temperature not lower than the dissolution temperature of the carbides to let the carbides dissolved, so that the carbides are precipitated finely at the time of heating to a quenching temperature. In this regard, however, if Nb, Ti, or other carbide-forming element were added with respect to the C content in the components of the present invention, it would not be possible to let the carbides dissolved sufficiently even by heating the steel to 1250° C. which is considerably higher than the practical heating temperature of steel materials. The pinning effect of the carbides would be insufficient, and coarse carbides would likely remain, adversely affecting the toughness. In contrast, V-containing carbides are dissolved at a lower temperature, so they can be effectively utilized for pinning the grain boundaries. To obtain this effect, V needs to be added in an amount of 0.15% or more, desirably 0.20% or more, and further desirably 0.25% or more. On the other hand, if V is contained in an amount of more than 0.50%, the effect of refining the grains will become saturated, and further, coarse carbides containing V will be formed, which carbides may impair hot workability or lead to reduced toughness. It is therefore necessary to keep the V content to be 0.5% or less, and desirably 0.45% or less. Accordingly, the V content is set to 0.15-0.50%, desirably to 0.20-0.50%, and further desirably to 0.25-0.45%.

Ni and Mo are elements from which one or both are contained. They are limited for the following reasons.

Ni: 2.50% or less

While Ni may be contained as an impurity in the present invention (in an amount of 0.07%, for example), Ni is an element effective in improving the hardenability and toughness, so it may be added intentionally. On the other hand, Ni is an expensive element, increasing the cost. Accordingly, the Ni content, when added, is set to 2.50% or less, and desirably to 1.70% or less.

Mo: 1.00% or less

While Mo may be contained as an impurity in the present invention (in an amount of 0.04%, for example), Mo is an element effective in improving the hardenability and toughness, so it may be added intentionally. On the other hand, Mo is an expensive element, increasing the cost. Accordingly, the Mo content, when added, is set to 1.00% or less, and desirably to 0.50% or less.

C+V: 0.60% or more

In order to achieve the grain refining function by dispersion of V-containing fine carbides, it is necessary to set a total amount of C and V to be at least 0.60% or more.

(Reasons for Causing the Microstructure to be a Martensitic Structure with Finely Dispersed Fe-Based ε Carbides)

In order to impart high hardness to the steel of the present invention, the microstructure is made to be martensite having Fe-based ε carbides finely dispersed therein. The martensite with finely dispersed Fe-based ε carbides is obtained through low-temperature tempering at 130° C. to 250° C. The steel of the present invention, by virtue of the chemical components and other restrictions defined in the solutions of the present invention, is capable of attaining the state of high toughness as quenched, and the excellent toughness is maintained in the low-temperature tempering at 130° C. to 250° C., eliminating the need to add alloy elements more than necessary. On the other hand, if the steel having the components within the scope of the present invention is subjected to high-temperature tempering conducted at a temperature of 500° C. or higher, instead of the low-temperature tempering, the hardness will be decreased due to the small amount of alloy elements contributing to secondary hardening. In such a case, although toughness may become still higher, high hardness cannot be achieved, hindering acquisition of required high hardness and high toughness. Accordingly, the martensitic structure having Fe-based ε carbides finely dispersed therein as a result of low-temperature tempering at 130° C. to 250° C. is adopted.

(Reasons for Setting the Maximum Diameter of V-Containing Carbides in Martensite to be 0.50 μm or Less and the Amount of Precipitated V-Containing Carbides to be 0.10-0.90 Vol % of the Total Martensite Volume)

When V-containing fine carbides having a diameter of 0.50 μm or less are dispersed in the martensite, the prior austenite grain size is prevented from coarsening and it is restricted to 20 μm or less, so that high toughness can be achieved simultaneously with high hardness. If the V-containing carbides being dispersed have a diameter of 0.50 pun or more, the grain refining effect will become small and toughness will decrease. If the amount of precipitated V-containing carbides in terms of volume % is less than 0.10 vol % of the total martensite volume, the effect of refining the prior austenite grain size cannot be obtained sufficiently. Therefore, the amount of precipitated V-containing carbides is set to 0.10 vol % or more, and the amount of precipitated V-containing fine carbides is desirably set to 0.15 vol % or more. On the other hand, if the amount of precipitated V-containing fine carbides exceeds 0.90 vol/%, the precipitated amount becomes too much, making the grains themselves including the V-containing carbides brittle, leading to decreased toughness. It is therefore set to 0.90 vol % or less, and desirably to 0.80 vol % or less. Accordingly, the maximum diameter of the V-containing carbides is controlled to be 0.50 μm or less and the amount of the precipitated V-containing carbides to be 0.10-0.90 vol %, and desirably 0.15-0.80 vol %, of the total martensite volume.

(Reasons for Setting the Proportion of the Amount of Precipitated Cementite to the Total Martensite Volume to be at Most 0.50 Vol % or Less)

Cementite would likely grow on the austenite grain boundaries during heating, which may cause cracking along the grain boundaries after quenching and tempering, thereby degrading the toughness. Accordingly, the amount of precipitated cementite is controlled to be at most 0.50 vol % or less of the total martensite volume.

(Reasons for Setting the Prior Austenite Grain Size to 20 μm or Less, and Desirably to 15 μm or Less)

When the prior austenite grain size in the quenched and tempered state is made fine, brittle fracture can be suppressed, leading to improved toughness. Further, when the prior austenite grain size is made small, the grain boundary area in the volume increases, and impurity elements such as P and S that would segregate in the grain boundaries and deteriorate toughness are dispersed over many grain boundaries, so that the amount of segregated impurities on individual grain boundaries can be decreased, which also contributes to improved toughness. Accordingly, the prior austenite grain size is set to 20 μm or less, and desirably to 15 μm or less.

An embodiment of the present invention will be described below with reference to Examples and Tables.

EXAMPLES

Steels having the chemical compositions of Inventive Examples Nos. 1 to 9 and Comparative Examples Nos. 10 to 15 shown in Table 1 below were produced in a 100-kg vacuum melting furnace. The obtained steels were each subjected to hot forging at 1150° C. to obtain a round bar steel of 26 mm in diameter. It should be noted that Table 1 shows indispensable chemical components as well as P and S as impurities, with the remaining Fe and other unavoidable impurities being omitted in Table 1.

TABLE 1

(Unit: mass %)

| | No. | C | Si | Mn | P | S | Ni | Cr | Mo | Al | V | Nb | C + V |
|---|---|---|---|---|---|---|---|---|---|---|---|---|---|
| Steel of Inventive Example | 1 | 0.81 | 0.48 | 0.20 | 0.011 | 0.005 | 0.07 | 2.02 | 0.04 | 0.010 | 0.30 | — | 1.11 |
| | 2 | 0.80 | 0.26 | 0.21 | 0.010 | 0.005 | 0.07 | 2.03 | 0.04 | 0.012 | 0.30 | — | 1.10 |
| | 3 | 0.80 | 0.26 | 0.20 | 0.010 | 0.005 | 0.07 | 2.32 | 0.04 | 0.021 | 0.34 | — | 1.14 |
| | 4 | 0.70 | 0.25 | 0.20 | 0.009 | 0.005 | 0.07 | 2.01 | 0.04 | 0.012 | 0.31 | — | 1.01 |
| | 5 | 0.61 | 0.26 | 0.20 | 0.010 | 0.005 | 0.07 | 2.00 | 0.04 | 0.022 | 0.30 | — | 0.91 |
| | 6 | 0.48 | 0.40 | 0.44 | 0.006 | 0.005 | 0.07 | 1.96 | 0.05 | 0.015 | 0.23 | — | 0.71 |
| | 7 | 0.45 | 0.70 | 0.44 | 0.006 | 0.005 | 0.07 | 1.96 | 0.04 | 0.015 | 0.31 | — | 0.76 |
| | 8 | 0.60 | 1.01 | 0.41 | 0.009 | 0.005 | 0.07 | 2.01 | 0.04 | 0.012 | 0.31 | — | 0.91 |
| | 9 | 0.62 | 0.99 | 0.39 | 0.011 | 0.005 | 0.07 | 1.98 | 0.30 | 0.015 | 0.30 | — | 0.92 |
| Steel of Comparative Example | 10 | 1.00 | 0.26 | 0.40 | 0.005 | 0.005 | 0.08 | 1.35 | 0.04 | 0.018 | — | — | 1.00 |
| | 11 | 0.80 | 0.26 | 0.21 | 0.010 | 0.005 | 0.07 | 1.36 | 0.04 | 0.014 | 0.30 | — | 1.10 |
| | 12 | 0.80 | 0.26 | 0.20 | 0.010 | 0.005 | 0.07 | 2.02 | 0.04 | 0.013 | — | — | 0.80 |
| | 13 | 0.60 | 0.26 | 0.20 | 0.010 | 0.005 | 0.08 | 2.00 | 0.04 | 0.017 | — | — | 0.60 |
| | 14 | 0.70 | 0.26 | 0.20 | 0.009 | 0.005 | 0.07 | 2.00 | 0.04 | 0.021 | — | 0.05 | 0.70 |
| | 15 | 0.49 | 0.49 | 0.50 | 0.006 | 0.006 | 0.07 | 1.92 | 0.04 | 0.018 | — | 0.05 | 0.49 |

*Shaded values are outside the scope of the claims.

Following forming the round bar steels described above, the round bar steels were subjected to normalizing, where they were held at 1000° C. for 15 minutes, then gas-cooled to 600° C., and then air-cooled. In this heat treatment, most part of V is dissolved in the matrix, with the rest being precipitated as V-containing fine carbides. Thereafter, the steels were roughly shaped into 10R C-notched Charpy impact test specimens, and those of Inventive Examples Nos. 1 to 9 and Comparative Examples Nos. 10, 12, 13, 14, and 15 were held at 950° C., in the austenite region of not lower than the dissolution temperature of cementite, for 60 minutes and then oil-quenched.

In the above-described heat treatment, in the steels of Inventive Examples Nos. 1 to 9, the V-containing carbides contained therein, which are finely precipitated while the steels are heated and held during the quenching, serve to pin the grains. It should be noted that, for the steels of Inventive Examples Nos. 1 to 9, the heating temperature conditions for quenching were selected so as to fall within the scope claimed in the present invention, while the steels of Comparative Examples Nos. 10, 12, 13, 14, and 15 having no V added thereto were heated according to the heating conditions of the steels of Inventive Examples. The steel of Comparative Example No. 11, containing V and having the chemical components falling within the scope of the present invention, was subjected to normalizing and then spheroidizing annealing with the heating temperature of 810° C., and roughly shaped into a 10R C-notched Charpy impact test specimen. It was then subjected to processing of holding at a temperature of 810° C., in the dual phase range of cementite and austenite, for 30 minutes and oil-quenching, which processing was repeated twice. The heating conditions for quenching of this steel of Comparative Example No. 11 are conditions for measuring the Charpy impact value when V-added steel is heated within the dual phase range of cementite and austenite. This test was carried out for comparison with the steels of Inventive Examples Nos. 1 to 9 of the present application.

Thereafter, all the roughly shaped test specimens were subjected to quenching and tempering, where they were held at a temperature range of 130° C. to 250° C. for low-temperature tempering for 180 minutes and then air-cooled. Further, the roughly shaped specimens were subjected to finishing work to obtain 10R C-notched Charpy impact test specimens.

As for the heat treatment, although not performed in the above-described processing, the steels of Inventive Examples Nos. 1 to 9 and Comparative Examples Nos. 10, 12, 13, 14, and 15 may be additionally subjected to spheroidizing annealing after the normalizing processing for the purposes of improving the material workability. In such a case, the spheroidizing annealing conditions may be adjusted as appropriate in accordance with the steel types, not limited to the upper-limit temperatures described in the present examples.

Table 2 shows hardness in terms of HRC, maximum diameter of V-containing carbides, amount of precipitated V-containing carbides with respect to total martensite volume, amount of precipitated cementite, prior austenite grain size, and Charpy impact value for the steels of Inventive Examples and Comparative Examples under the conditions of the embodiment of the invention.

TABLE 2

| | No. | Hardness (HRC) | Maximum diameter of V-containing carbides (μm) | Amount of precipitated V-containing carbides (vol %) | Amount of precipitated cementite (vol %) | Prior austenite grain size (μm) | Charpy impact value (J/cm$^2$) |
|---|---|---|---|---|---|---|---|
| Steel of Inventive Example | 1 | 60 | 0.43 | 0.36 | 0 | 9 | 112 |
| | 2 | 60 | 0.46 | 0.34 | 0 | 8 | 112 |
| | 3 | 59 | 0.36 | 0.34 | 0 | 11 | 151 |
| | 4 | 59 | 0.47 | 0.30 | 0 | 7.5 | 239 |
| | 5 | 59 | 0.37 | 0.25 | 0 | 4.5 | 239 |
| | 6 | 58 | 0.35 | 0.25 | 0 | 11 | 140 |
| | 7 | 57 | 0.32 | 0.16 | 0 | 5.7 | 234 |
| | 8 | 60 | 0.36 | 0.35 | 0 | 6 | 148 |
| | 9 | 60 | 0.38 | 0.46 | 0 | 4.8 | 180 |
| Steel of Comparative Example | 10 | 61 | includes no V-based carbide | 0 | 0 | 27 | 7 |
| | 11 | 61 | 0.65 | 0.67 | 0.71 | 9 | 41 |
| | 12 | 60 | includes no V-based carbide | 0 | 0 | 28 | 14 |
| | 13 | 60 | includes no V-based carbide | 0 | 0 | 30 | 92 |
| | 14 | 60 | includes no V-based carbide | 0 | 0 | 12 | 60 |
| | 15 | 60 | includes no V-based carbide | 0 | 0 | 30 | 63 |

*Shaded values are outside the scope of the claims.

The steels of Inventive Examples Nos. 1 to 9 are all excellent in toughness with the 10R C-notched Charpy impact value exceeding 100 J/cm$^2$, while exhibiting high hardness of 57 HRC or more. Such high toughness is achieved because, with the steels of the present invention having indispensably added V, the test specimens do not suffer brittle fracture when hit by a Charpy impact tester, but experience ductile deformation to some extent before being fractured. The steels of Comparative Examples Nos. 10, 12, 13, 14, and 15 have no V added thereto. While the steel of Comparative Example No. 11 has V added thereto and its chemical components are within the scope of the present invention, the results of heat treatment fall outside the scope of the present invention. The steels of Comparative Examples all have a low impact value as compared to the steels of Inventive Examples.

In particular, the results of No. 11 show that it is useful to control the microstructure appropriately, let alone the chemical components, to achieve satisfactory hardness and toughness simultaneously. It is also clear from the results of Nos. 14 and 15 that, while V and Nb are in the same group on the periodic table, they cannot be easily substituted because with V, satisfactory hardness and toughness can both be achieved whereas with Nb, Nb-containing carbides cannot be utilized effectively for pinning the grain boundaries, hindering achievement of good hardness and toughness at the same time. It has thus become apparent that adding V as an additive element is useful.

It should be understood that the embodiment and the examples disclosed herein are illustrative and non-restrictive in every respect. The scope of the present invention is defined by the terms of the claims, rather than the description above, and is intended to include any modifications within the scope and meaning equivalent to the terms of the claims.

The invention claimed is:

1. A steel with high hardness and excellent toughness, containing, in mass %, 0.40-1.00% C, 0.10-2.00% Si, 0.10-1.00% Mn, 0.030% or less P, 0.030% or less S, 1.10-3.20% Cr, 0.010-0.10% Al, and 0.15-0.50% V, and further containing at least one of 2.50% or less Ni and 1.00% or less Mo, with an amount of (C+V) being 0.60% or more in mass %, with the balance consisting of Fe and unavoidable impurities, the steel having a microstructure which is a martensitic structure with finely dispersed Fe-based ε carbides and with a prior austenite grain size of 20 μm or less, wherein the martensitic structure tempered at a low temperature of 130° C. to 250° C. has V-containing fine carbides with a diameter of 0.50 μm or less precipitated dispersively therein, an amount of the precipitated V-containing fine carbides constitutes 0.10-0.90 vol % of a total martensite volume, and an amount of precipitated cementite in the martensitic structure tempered at the low temperature of 130° C. to 250° C. constitutes 0.50 vol % or less of the total martensite volume.

* * * * *